US005522413A

United States Patent [19]

Kuwahara

[11] Patent Number: 5,522,413

[45] Date of Patent: Jun. 4, 1996

[54] REMOVABLE SUNSHADE FOR SAILBOATS

[76] Inventor: Akira Kuwahara, 1-10-4-203 Kugenuma-Kaigan, Fujisawa-shi Kanagawa, Japan

[21] Appl. No.: 206,641

[22] Filed: Mar. 7, 1994

[30] Foreign Application Priority Data

May 17, 1993 [JP] Japan ..... 5-033066 U

[51] Int. Cl.[6] ..... E04H 15/06

[52] U.S. Cl. ..... 135/88.01; 135/90; 135/115

[58] Field of Search ..... 135/87, 90, 96, 135/88.01, 115, 119, 88.09

[56] References Cited

U.S. PATENT DOCUMENTS

| | | | |
|---|---|---|---|
| 35,922 | 7/1862 | Chapelle | 135/96 X |
| 1,780,322 | 11/1930 | Tsuji | 135/90 X |
| 3,032,046 | 5/1962 | Coonradt | 135/90 |
| 4,308,883 | 1/1982 | Malone | 135/90 |

*Primary Examiner*—Lanna Mai

[57] ABSTRACT

A sunshade which can be easily attached to and removed from the backstay of a sailboat. This sunshade is positioned so as not to interfere with the sail, and was designed to be attached behind the boom, so that it can be used under sail. This sunshade is constructed of two sheets shaped like isosceles triangles arranged with their bottom edges together to form a diamond shape, with a pair of spars fixed in place bisecting this diamond (perpendicular to the opening between the sheets). The sheets are not joined together, so that when the sunshade is attached to a boat, there is a space for the backstay to pass through. The spar combination is provided with multiple holes for adjustment when attached to the boat. This sunshade is suspended from the backstay with the spar combination topmost and the corners of the triangles at the bottom, being tied tightly to their respective sides of the boat.

1 Claim, 4 Drawing Sheets

REMOVABLE SUNSHADE FOR SAILBOATS

BACKGROUND OF THE INVENTION

This invention is a sunshade that is affixed to the backstay of a sailboat and can be easily attached and detached.

Existing sunshades for sailboats consist of either semi-permanent attachments utilizing stainless-steel tubing or similar materials, or simple sheets hung from the boom. Both of these have their drawbacks. The former are usually made-to-order to fit a particular boat, and cannot be removed on occasions when there is little sunlight. The latter are suspended from the boom, which is used to maintain tension on the sail, and thus cannot be used while actually sailing.

SUMMARY OF THE INVENTION

This invention was conceived to eliminate these drawbacks, while serving to block strong, direct sunlight while under sail and/or at anchor.

DETAILED DESCRIPTION OF THE INVENTION

Figure 1:
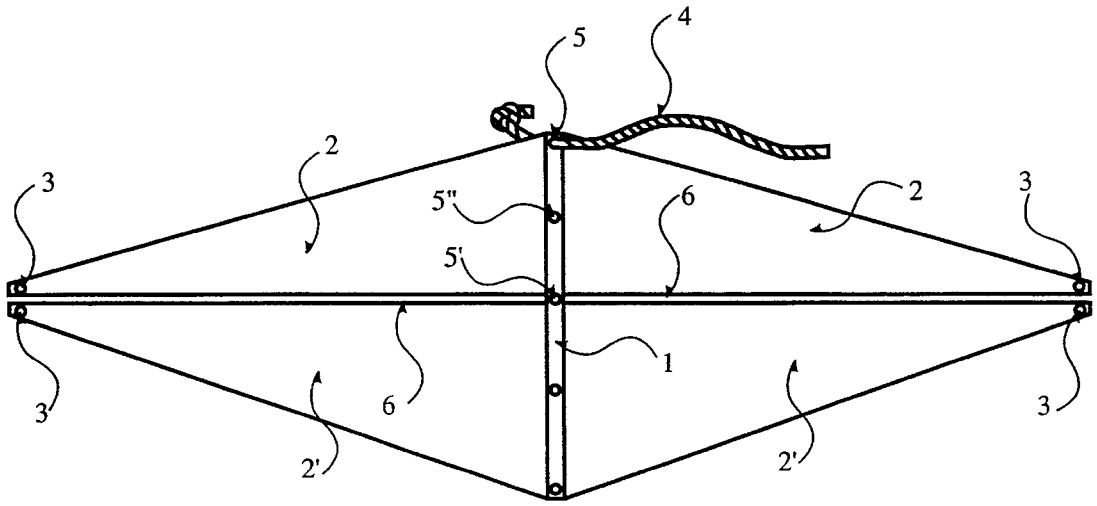
FIG. 1 is a plan view of the sunshade. This shows the sunshade as it would appear when laid flat, not as it appears in actual use.

As shown in FIG. 1, the sunshade consists of two sheets (2), each in the form of an isosceles triangle, which have been laid out with their long sides together to form a diamond shape. Bisecting this diamond (perpendicular to the long sides of the sheets) are 2 flat spars (1) which are fixed in place, sandwiching the sheets. The sheets are not joined along the long edges, thus creating an opening (6) for the backstay (explained below).

The spar combination (1) is the point at which this invention is connected to the boat, by way of an attachment line (4). Multiple holes in the spar (5) are provided to facilitate attachment to any type of boat by allowing adjustable fore-aft positioning (at least three holes). Grommets (3) are positioned at both corners of each sheet, permitting the sunshade to be secured to the boat.

This invention is intended to be used as a sunshade for use solely with sailboats. Most sailboats have a backstay, which is used to support the mast. They also require a boom to unfurl the main sail. Thus, the obstacles posed by the complex nature of the rigging on sailboats make it difficult to erect a sunshade.

Figure 2:
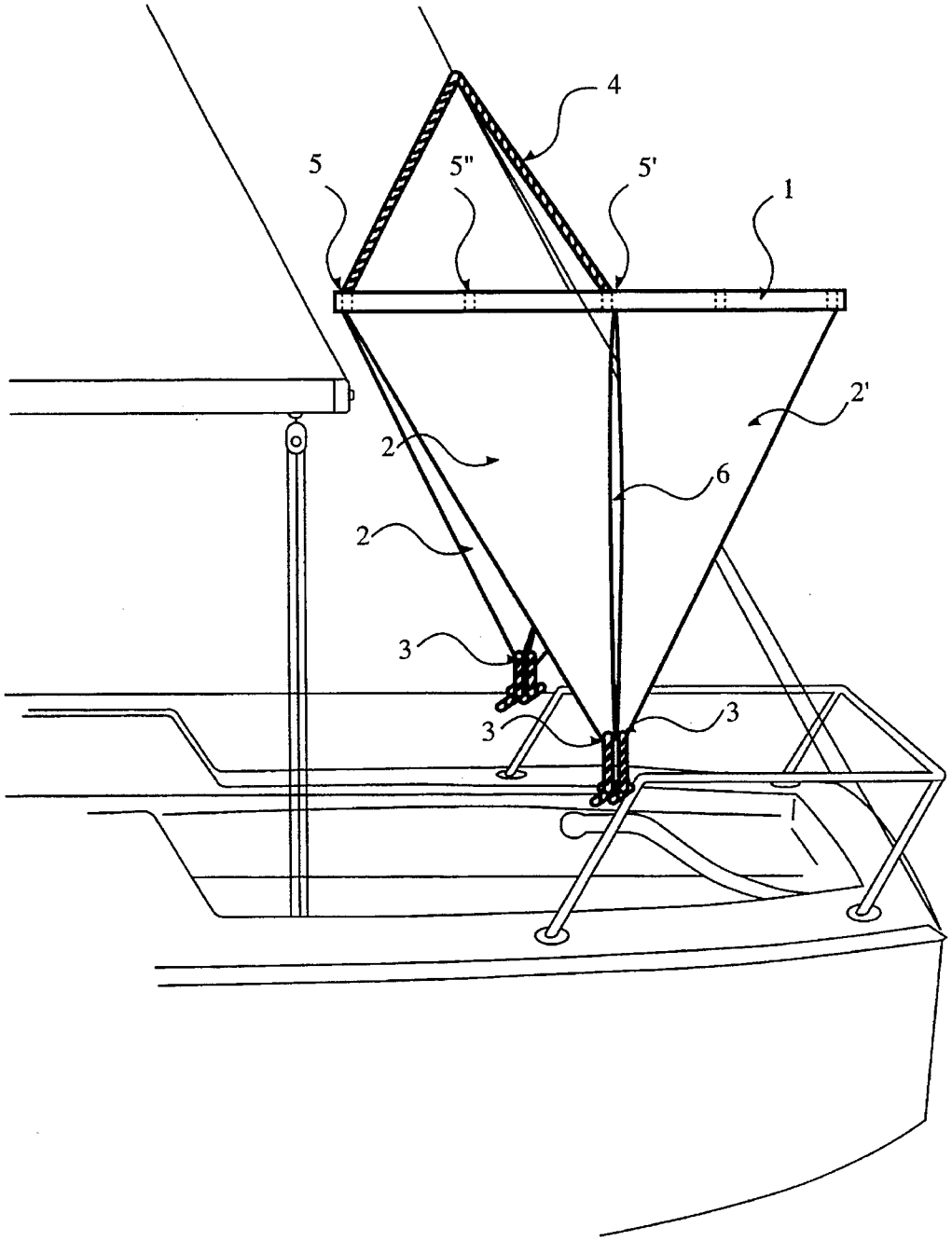
FIG. 2 is a side view of the sunshade as it would appear in use on a sailboat.

However, as shown in FIG. 2, this invention was designed to accommodate the backstay and boom of any sailboat.

To set up the sunshade as shown in FIG. 2, the spar combination (1) is suspended from the backstay of the sailboat to form the upper part of the sunshade. Then the grommets (3) at the lower comer of each sheet are tied to their respective sides of the boat, affixing the sunshade.

More specifically, the set up of this invention would involve tying the attachment line (4) to the foremost of the top-mount holes (5), tying the attachment line (4) to an appropriate point on the backstay, and then running the remainder of the attachment line (4) back to another of the top-mount holes (5') and tying it there so that the attachment line (4) forms a triangular shape. If, at this point, the boom and the spar combination (1) overlap each other, the attachment line's (4) rear mounting (5') should be re-attached at a more forward hole (5"), to ensure that the boom and the upper part of the sunshade do not much. The provision of multiple mounting points on the spar makes it possible to easily attach the sunshade to any type of sailboat, and adjust its positioning to maintain proper distance between the boom and the sunshade.

Next the openings (6) are positioned around the backstay, and the grommets (3) at the lower comers are pulled taut and tied in place against either side of the pulpit, the lifeline, or another appropriate part of the boat.

Figure 3:
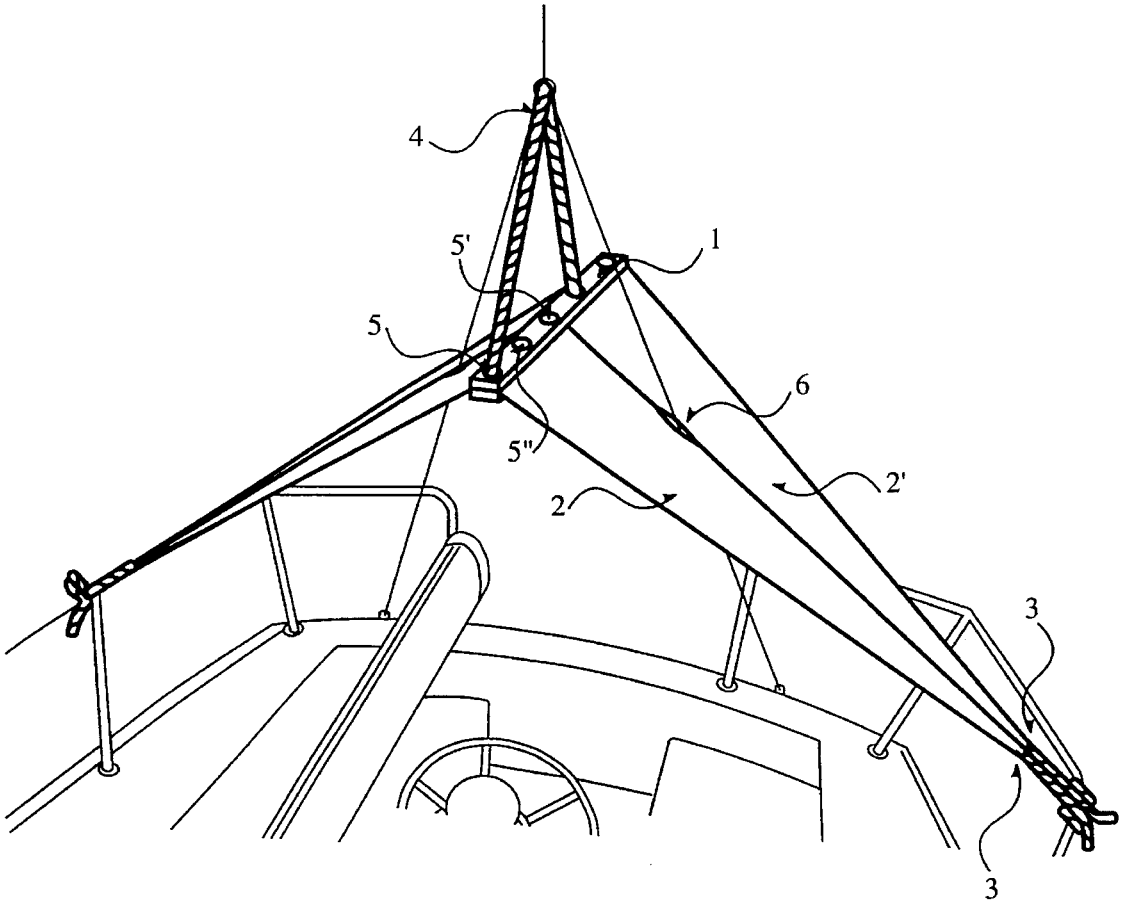
FIG. 3 is one-quarter view of the sunshade as it would appear in actual use.
Figure 4:
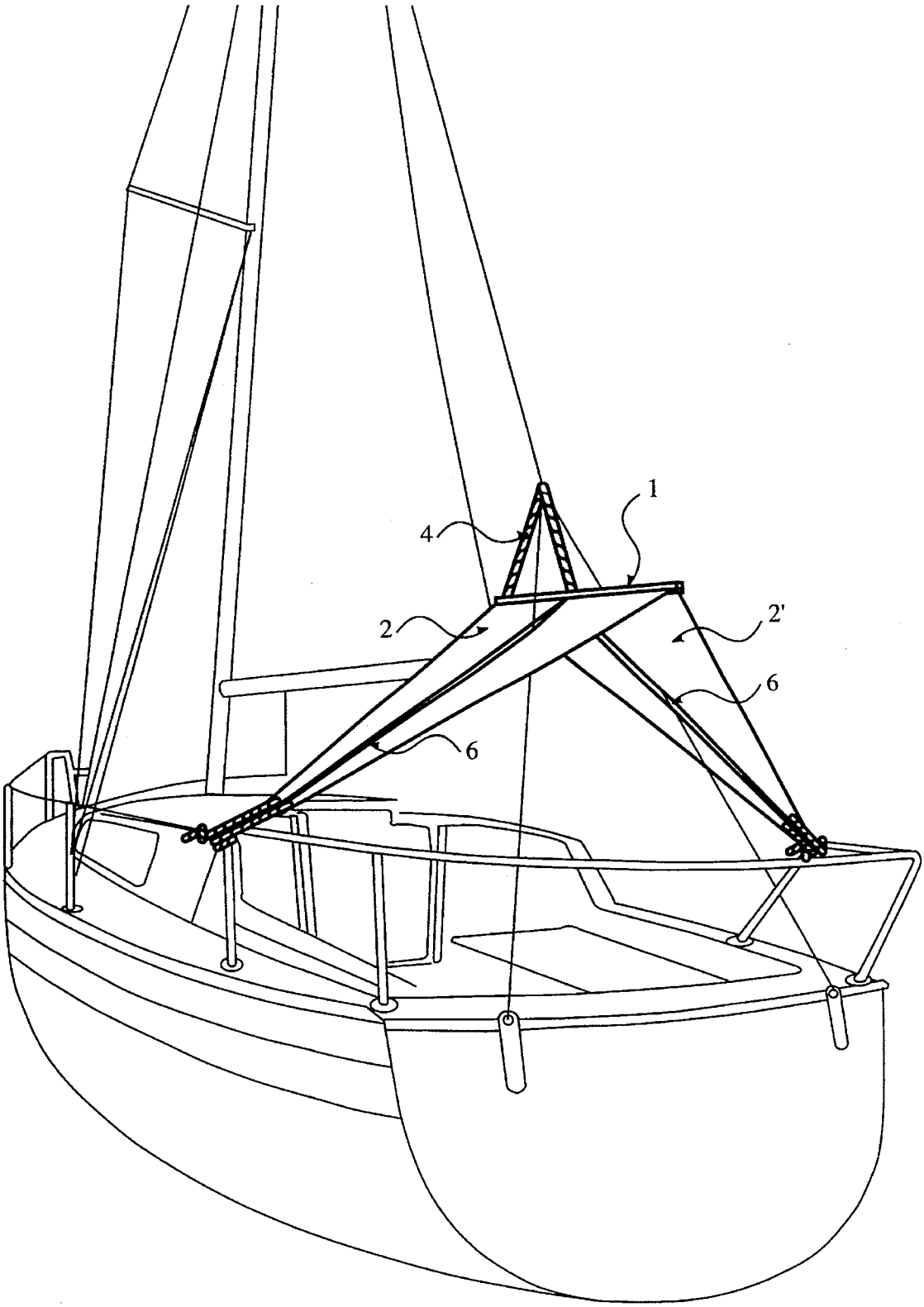
FIG. 4 is a three-quarter view of the sunshade as it would appear in actual use.

FIGS. 3 and 4 show the attachment line (4) tied to the backstay and the grommets (3) tied to the lifeline or other position on the boat. Tying the sunshade in multiple locations helps keep it stable in strong winds. Furthermore, when attached, the sunshade forms a pair of inverted triangles with bases above and tips below, allowing the operator a clear field of view, for greater safety. Finally, since the sunshade does not overlap the tip of the boom, which is needed to keep the sail taut, the sunshade can be used under sail without difficulty.

Other noteworthy advantages of this invention are that it can be easily erected when the sunshine is strong, and easily taken down when not needed, and since it is made mostly out of fabric, it can be rolled up and stored compactly onboard.

What is claimed:

1. A removable sunshade for use with sailboats, consisting of:

two isosceles triangle-shaped sheets each having an elongated lower edge and a centerline extending perpendicular to said lower edge; said triangle-shaped sheets are laid parallel together along the lower edges such that the centerlines are aligned;

spars affixed along said centerlines of said triangle-shaped sheets and joining said triangle-shaped sheets together leaving the rest of said lower edges unjointed;

Spaced-apart openings are formed on said spars through said centerlines as a means of attaching said triangle-shaped sheets to a sailboat.

* * * * *